United States Patent [19]

Carlson

[11] Patent Number: 4,730,829

[45] Date of Patent: Mar. 15, 1988

[54] EXERCISE MACHINE

[75] Inventor: Robert B. Carlson, Bloomington, Minn.

[73] Assignee: The Toro Company, Minneapolis, Minn.

[21] Appl. No.: 67,185

[22] Filed: Jun. 26, 1987

Related U.S. Application Data

[62] Division of Ser. No. 675,366, Nov. 27, 1984, abandoned.

[51] Int. Cl.[4] ..... A63B 21/24

[52] U.S. Cl. ..... 272/129; 272/134; 272/DIG. 4; 128/25 R

[58] Field of Search ..... 272/72, 73, 93, 100, 272/103, 116, 117, 118, 120, 125, 129, 130, 132, 134, 136, 144, 146, DIG. 4; 128/25 R

[56] References Cited

U.S. PATENT DOCUMENTS

| | | | |
|---|---|---|---|
| 2,884,252 | 4/1959 | Thompson | 272/100 X |
| 3,079,914 | 3/1963 | Bush | 272/129 X |
| 3,323,366 | 6/1967 | De Lorme et al. | 272/134 X |
| 3,465,592 | 9/1969 | Perrine . | |
| 3,495,824 | 2/1970 | Cuinier . | |
| 3,511,097 | 5/1970 | Corwin . | |
| 3,581,739 | 6/1971 | Brandt | 272/146 X |
| 3,708,166 | 1/1973 | Annas . | |
| 3,721,438 | 3/1973 | Kosmer | 272/132 X |
| 3,848,467 | 11/1974 | Flavel . | |
| 3,858,873 | 1/1975 | Jones . | |
| 3,989,240 | 11/1976 | Victor et al. . | |
| 4,082,267 | 4/1978 | Flavell | 272/125 |
| 4,084,810 | 4/1978 | Forsman . | |
| 4,125,258 | 11/1978 | McAuther | 272/118 |
| 4,176,836 | 12/1979 | Coyle | 272/120 |
| 4,184,678 | 1/1980 | Flavell et al. | 272/129 |
| 4,200,279 | 4/1980 | Lambert, Jr. | 272/118 |
| 4,204,673 | 5/1980 | Speer, Sr. | 272/129 X |
| 4,231,568 | 11/1980 | Riley et al. | 272/134 X |
| 4,240,627 | 12/1980 | Brentham | 272/134 X |
| 4,286,782 | 9/1981 | Fuhrhop | 272/117 |
| 4,311,305 | 1/1982 | Lambert, Jr. et al. | 272/118 |
| 4,319,747 | 3/1982 | Rodgers | 272/134 X |
| 4,337,050 | 6/1982 | Engalitcheff, Jr. | 272/129 X |
| 4,354,675 | 10/1982 | Barclay et al. | 272/118 |
| 4,354,676 | 10/1982 | Ariel | 272/129 |
| 4,372,551 | 2/1983 | Yurdin | 272/73 |
| 4,382,596 | 5/1983 | Silberman | 272/118 |
| 4,390,179 | 6/1983 | Szkalak | 272/118 |
| 4,408,759 | 10/1983 | Reneau et al. | 272/131 |
| 4,429,871 | 2/1984 | Flechner | 272/134 X |
| 4,465,274 | 8/1984 | Davenport | 272/130 |
| 4,556,216 | 12/1985 | Pitkanen | 272/134 X |
| 4,577,623 | 3/1986 | Pecheux | 272/129 X |
| 4,577,862 | 3/1986 | Sagedahl | 277/125 |
| 4,600,189 | 7/1986 | Olschansky et al. | 272/118 |
| 4,611,807 | 9/1986 | Castillo | 272/132 |
| 4,620,703 | 11/1986 | Greenhut | 272/129 |

*Primary Examiner*—Richard J. Apley
*Assistant Examiner*—Robert W. Bahr
*Attorney, Agent, or Firm*—James W. Miller

[57] ABSTRACT

An exercise machine (2) includes side frame members (6). Electromagnetic brakes (62) supported on movable carriages (66) slide along side frame members (6). Carriage (66) includes a hinge (100) for allowing each brake (62) to pivot between multiple positions. Both types of motion allow the output shafts (64) on brakes (62) to be reoriented relative to a support bench (20) on which a user of machine (2) is located. Various exercise attachments may be coupled to brake shafts (64) for contacting various body members to perform different exercises. A controller (200) regulates the force levels of brakes (62).

4 Claims, 24 Drawing Figures

EXERCISE MACHINE

This is a division of application Ser. No. 06/675,366, filed Nov. 27, 1984, now abandoned.

TECHNICAL FIELD

The present invention relates to an exercise machine for exercising many of the major muscle groups of the body. More specifically, the present invention relates to such a machine which is very versatile, which uses electrically operated brakes as the resistance means against which the muscles work, and which has a novel controller for regulating the force levels provided by the brakes. While the exercise machine is primarily used for anaerobic exercise, it may also be used for aerobic exercise.

BACKGROUND OF THE INVENTION

The health benefits of a well-rounded exercise program have become increasingly well known in recent years. Current medical thinking suggests such a program should include both aerobic and anaerobic exercise. Aerobic exercise is any exercise which conditions the cardiovascular system by increasing the heart rate of the person undergoing the exercise and maintaining that heart rate in an elevated range for at least 10–15 minutes. On the other hand, anaerobic exercise seeks to increase muscle size and the capacity of the muscle for performing work, i.e. the so-called "body building" exercises. Anaerobic exercise does not generally provide any aerobic benefit.

Aerobic exercise can be accomplished by walking, running, swimming or undertaking any physical activity which causes the elevated heart rate. Moreover, various machines have been developed for use as aerobic exercisers. Such machines include stationary bicycles, treadmills, rowing machines, cross country skiing machines and the like. Such machines can also be used indoors and are often desirable when weather conditions would otherwise make it difficult to perform outside forms of aerobic exercise.

Similarly, many devices have been developed to exercise muscle groups anaerobically. The most traditional of these is the freestanding barbell or weight set. In addition, however, various machines have been developed for use in gyms, such as the Universal weight machines or the machines embodied in the Nautilus system. For example, a typical Universal weight machine comprises a rectangular frame having a plurality of stations located along the sides of the frame. A plurality of weight stacks are carried by the frame and are connected to various implements or attachments. The weight stacks can have the weight varied by means of a releasable lock pin. Basically, the operator goes from one station to another performing different exercises at each, for example, the chest press, the leg press and the like.

The Nautilus system is also notable. This system includes many specialized exercise machines which are devoted generally to performing just one, or at most a few, of the many exercises required for exercising all the muscle groups of the body. In fact, there are at least 17 individual machines in the complete Nautilus system for performing in excess of 25 exercises. Each of the machines generally includes a support bench on which the operator sits or lies and a weight stack. The weight stack is connected through a rotatable cam to an implement which the operator rotates or pushes against as the case may be. The purpose of the cam is to cause a relatively constant exercising force against the muscle throughout the entire range of motion of the exercise. Some of the principles behind the Nautilus system, and particularly the use of the cam, are explained in more detail in U.S. Pat. No. 3,858,873 to Jones.

While the Universal and Nautilus systems are effective, they have numerous disadvantages. For example, the basic rectangular Universal exercise machine is relatively heavy, bulky and is limited in the number of exercises it can perform. For example, a second separate machine is required, even in the Universal system, to perform leg curl and leg extension exercises. However, this machine cannot perform leg abduction or adduction exercises. Moreover, the Nautilus system best typifies the practice of having separate machines for performing separate exercises, thereby requiring a vast array of machines to exercise the body in a reasonably complete fashion. Obviously, the expense required in purchasing such machines, and the relatively large area in which such machines need to be installed, render them unfit or unsuitable for use by the consumer in his home. They generally appear only in gymnasiums, health clubs or other organized sports facilities.

In fact, when one considers the equipment available to be purchased by the consumer for home use at the current time, it is relatively limited. Most of this equipment usually involves some type of exercise bench having pivotal rollers at one end which can be used to perform leg extension and leg curl exercises. The other end of the bench often has a crosspiece member for holding barbells or the like. In addition, spring tension exercisers are often included on such benches.

Various recent patents suggest that it would be desirable for a consumer to have in his home an exercise machine for exercising many different muscle groups. U.S. Pat. Nos. 4,429,871 to Flechner and 4,465,274 to Davenport are two recent examples showing how those skilled in the art have approached this problem. The basic thrust behind the devices shown in these patents is to have a support member on which the user sits which allows rotary motion of the arms and legs about the horizontal pivot axes through the knees, elbows and shoulders. However, these machines also allow further pivoting motions about the vertical axes through the hips and the shoulders. The Flechner device accomplishes this by having separate stations at which the user is positioned depending on which type of pivoting motion is required. Davenport accomplishes this by having a separable attachment which connects to the machine when differently oriented pivot axes are required.

While these two patents have recognized the need for a more versatile machine, they again have numerous disadvantages. For example, most of the exercise attachments against which the user pushes to exercise require their own separate hydraulic cylinders as the force resisting elements. The use of so many separate hydraulic cylinders increases the complexity and expense of the machine. Moreover, hydraulic cylinders are not ideally suited for use in the home since they can leak hydraulic fluid. In addition, the approach to solving the problem of exercises requiring movement about the vertical axes through the hips or the shoulders is somewhat clumsily achieved. Basically, it requires totally separate force resisting elements, in one case arranged at a separate station, for accomplishing this. In addition, it also requires the user to be positioned on the support bench in less than the ideal exercise position because of the geometric limitations of the machine.

It has been suggested that electromagnetic brakes have some utility in aerobic exercise machines. For example, U.S. Pat. No. 4,084,810 to Forsman discloses an electromagnetic brake used as the force resister in a stationary bicycle. However, the Applicant is not aware of any electromagnetic brakes used in an exercise machine capable of exercising both sides of the body in an anaerobic fashion. U.S. Pat. No. 4,337,050 to Engalitcheff shows an electromagnetic brake that is mounted to the top of a table. The brake can be pivoted so that its armature shaft is either vertically pointing toward the ceiling or horizontally pointing toward the wall. Various attachments simulating everyday implements, such as screwdrivers or the like, can be attached to the armature. These attachments are then gripped by a person having damaged muscles who attempts to turn the implement in an ordinary fashion to rehabilitate his muscles. While this is a use of an electromagnetic brake in other than a stationary bicycle, it does not teach the use of such a brake in a fashion which is effective as an anaerobic exercise machine.

Finally, Applicant is aware of an International Application, Publication Number WO80/00308, which was published Mar. 6, 1980. This application discloses a device used for measuring muscular strength having a support bench which can be raised up and down on a scissors framework and which can be slid longitudinally front to back on the framework as well. A carriage is arranged to carry a force resistor from one side of the bench to the other for measuring the muscular strength of the muscles on each side of the body. The force resistor is also pivotally arranged so that its working axis can be shifted from a horizontal to a vertical orientation. It is also recognized that some exercise benefit could be obtained from this arrangement.

While the International Application referenced above discloses a movable and pivotable force resistor, it does not disclose an effective exercise machine. For one thing, it appears to disclose testing or exercising only one-half of the body at a time since the brake has to be moved from one side to the other. In addition, it does not disclose use of an electromagnetic brake, but a different type of force resistance means which is relatively complex. In addition, many of the exercises could be accomplished on this mechanism only in less than ideal positions. Accordingly, this publication does not disclose an effective versatile exercise machine.

SUMMARY OF THE INVENTION

The present invention relates to an exercise machine utilizing an electrically operated brake, i.e. perferably an electromagnetic brake, which is bodily movable for exercising many of the major muscle groups of the body. In fact, the exercise machine of this invention utilizes two such brakes capable of simultaneously exercising the opposed sides of the body.

One aspect of the present invention is an exercise machine having a frame on which two force resisters are longitudinally movable for exercising the muscle groups in both the lower body and the upper body. The force resisters are pivotally mounted so that they are also effective in exercising body members that pivot in different planes.

Another aspect of this invention is the use of an electrically operated brake or resistance means in an exercise machine in which the resistance is separately controlled during muscle extension and muscle contraction.

Another aspect of the present invention is an exercise machine in which an electromagnetic brake can be used to exercise muscle groups in both an aerobic manner and an non-aerobic manner. Aerobic exercise is allowed by setting the force levels of the brake relatively low to allow a large number of repetitions. Anaerobic exercise is achieved by setting force levels relatively high with a corresponding fewer number of repetitions.

Another aspect of this invention is an exercise machine having a frame in which two side frame members extend from a position generally beneath the operator to a position above the operator. Force resistance means are movable along each of the side frame members. The side frame members are inclined outwardly in a transverse direction so that the shafts of the force resisters are spaced apart further when they are located above the operator than when they are located beneath the operator. Moreover, another aspect of this invention is such an exercise machine in which the side frame members extend in an arcuate curve from front to back.

Another aspect of this invention is the provision of an exercise machine that is amazingly versatile. For example, a single exercise machine is now capable of performing various exercises while the user is supported in the optimum position.

BRIEF DESCRIPTION OF THE DRAWINGS

The present invention will be described in more detail in the following Detailed Description, when taken in conjunction with the following drawings, in which like reference numerals refer to like elements throughout.

DETAILED DESCRIPTION

Figure 1:
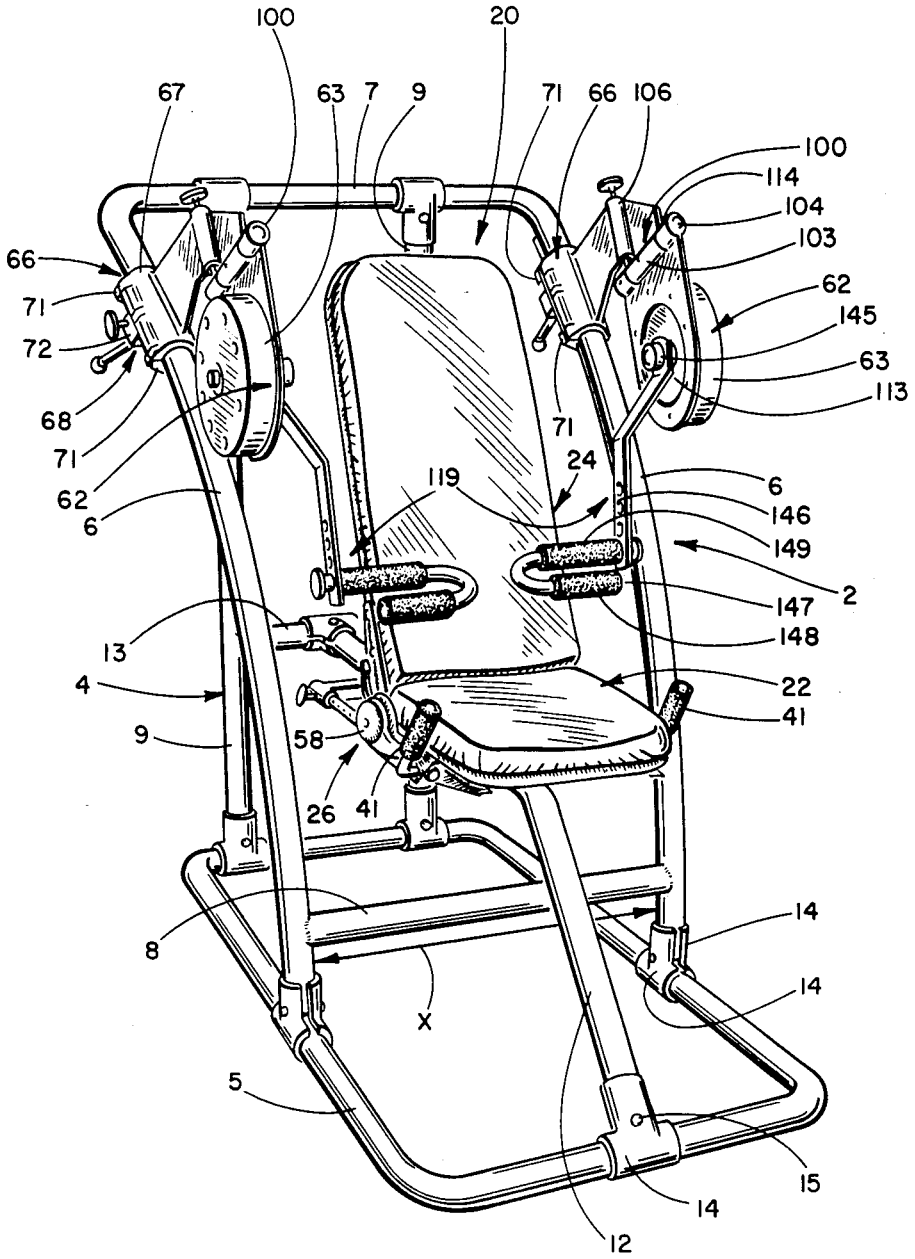
FIG. 1 is a perspective view of the overall exercise machine according to the present invention.
Figure 2:
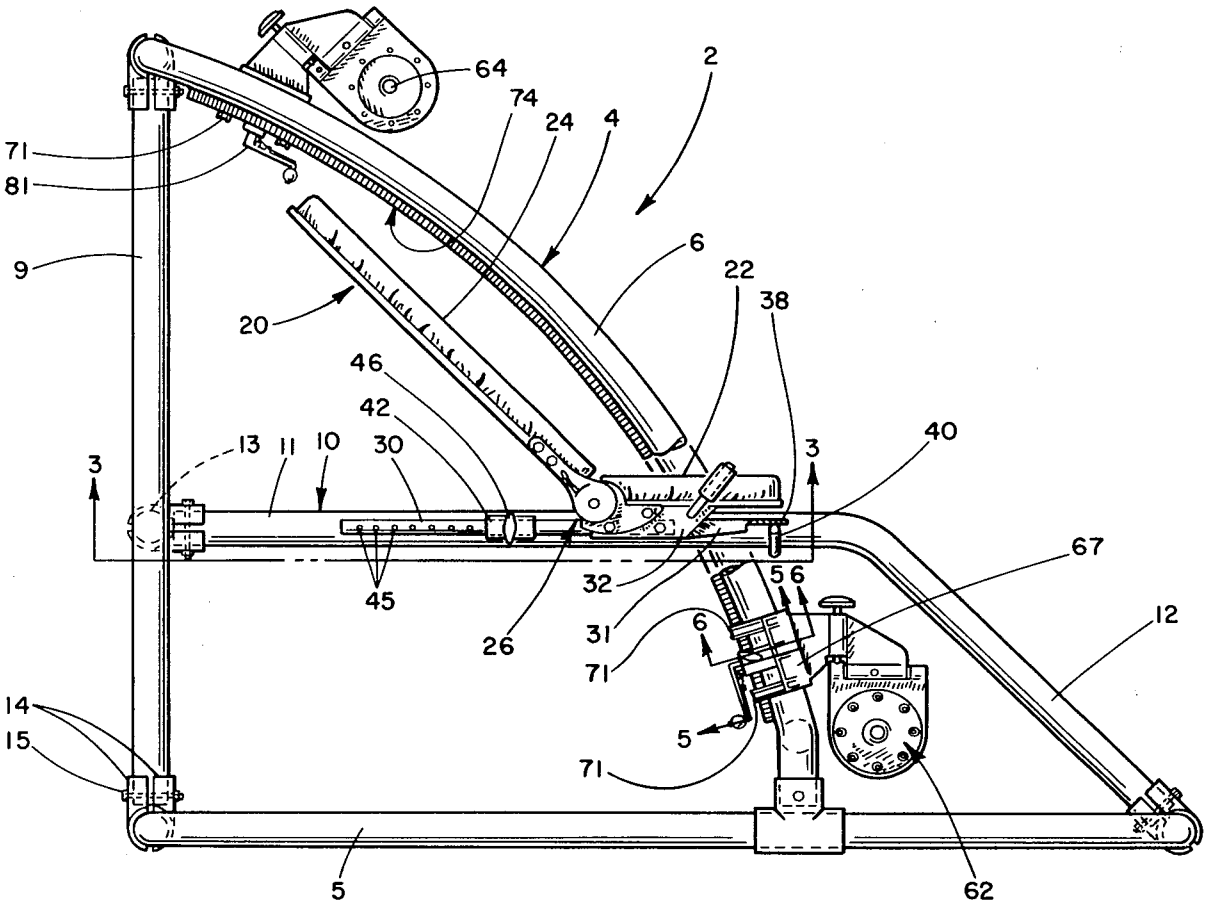
FIG. 2 is a side elevational view of the exercise machine shown in FIG. 1, having one of the side frame members partially broken away to better illustrate the support bench for the user of the machine.

Referring to FIGS. 1 and 2, an exercise machine according to the present invention is generally illustrated as 2. By way of introduction, exercise machine 2 comprises a frame 4 that includes a support bench 20 on which a user may sit or lie as the case may be. Frame 4 carries resistance means for exercising various muscle groups on each side of the body of a user who is supported on bench 20. The resistance means comprises two electrically operated brakes 62, preferably electromagnetic brakes, which are longitudinally movable on frame 4 for exercising both lower body and upper body muscles, and which are also pivotal on frame 4 so that the working axes of brakes 62 can be shifted between different orientations to accommodate exercising movements that require body members to pivot in different planes. The resistance afforded by brakes 62 is controlled by a novel controller 200 which also displays various physiological data to the user of machine 2.

The Frame

As shown in FIGS. 1 and 2, frame 4 includes a rectangular base frame 5 sized to cover an area on the floor sufficiently large so that the overall exercise machine 2 is stable during use. Two left and right side frame members 6 are attached to each side of base frame 5 somewhat in back of the front edge thereof. Side frame members 6 extend vertically upwardly in an arcuate curve from front to back such that their upper ends are located generally above the rear edge of base frame 5. A top rail 7 integrally connects the upper ends of side frame members 6 together. Thus, side frame members 6 and top rail 7 can be said to define a U-shaped frame in which the opposed legs of the U are defined by the transversely spaced apart side frame members 6 while top rail 7 defines the closed end of the U. In addition, a transverse crosspiece 8 extends between side frame members 6 adjacent their lower ends to reinforce the same.

Frame 4 also includes two rear rails 9 which extend vertically between top rail 7 and base frame 5 to further rigidify and reinforce frame 4. In addition, frame 4 includes a longitudinally extending rail 10 having a generally horizontal rear portion 11 and a downwardly inclined forward portion 12. Forward portion 12 of rail 10 is attached to the mid-point of base frame 5 adjacent the front edge thereof. The rear end of horizontal portion 11 of rail 10 is attached to a horizontal crosspiece 13 that extends between rear rails 9 about a third of the way up the length thereof. Rail 10 provides means for slidably supporting a support bench 20 on frame 4 as will be described hereafter.

All of the portions of frame 4 described thus far, i.e. bae frame 5, side frame members 6, etc., comprise or are made from generally cylindrical, hollow tubes made of steel or any other sufficiently strong material. Except for some welding in base frame 5 and at the points of attachment of crosspieces 8 and 13, the tubes are connected together by opposed T-shaped clamps 14 secured together by bolts 15. These bolts 15 extend through the opposed clamps 14 and may also extend through a hole in the end of one of the tubes being secured together. However, other materials could be used for the frame pieces along with any appropriate methods of securing them together. For example, base frame 5 could be a solid rectangular piece rather than the open rectangular framework defined by the cylindrical tubes.

Frame 4 has two significant geometric characteristics which should be noted initially here. The first is the aforementioned arcuate curve on side frame members 6 as they rise vertically from front to back as shown in FIG. 2. The second is the fact that the side frame members 6 are also slightly inclined or bowed outwardly in a transverse direction as they rise vertically from front to back, i.e. the transverse distance between side frame members 6 (denoted as X in FIG. 1) gradually and progressively increases as they rise vertically from bottom to top. Both of these characteristics help properly orient the working axes of the brakes for accomplishing various exercises as will be explained in more detail hereafter.

The Support Bench

Figure 3:
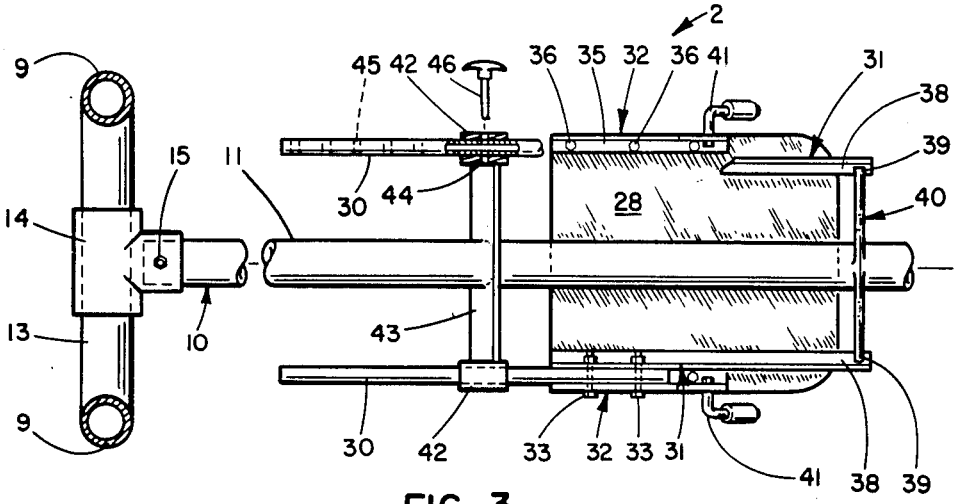
FIG. 3 is a partial cross-sectional view taken along lines 3—3 in FIG. 2, particularly illustrating the underside of the seat of the support bench and the manner in which it attaches to the frame of the exercise machine.
Figure 4:
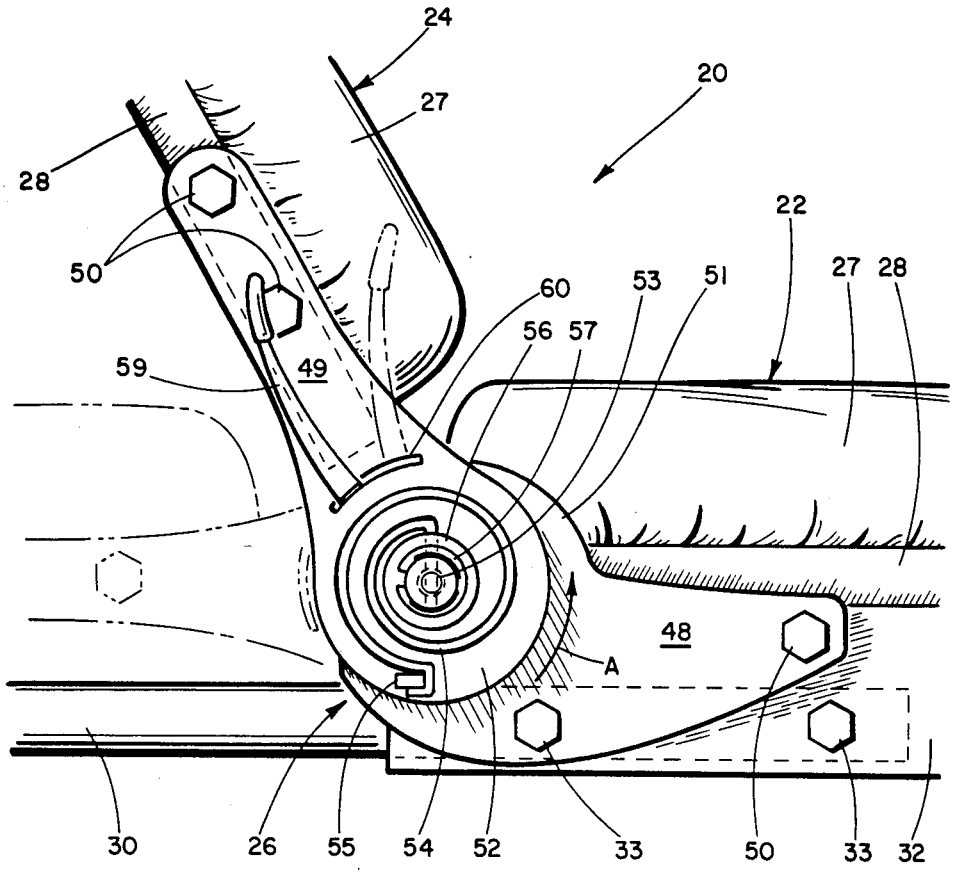
FIG. 4 is side elevational view of a portion of the support bench, particularly illustrating the hinged connection between the seat and back rest portions of the support bench.

Referring now to FIGS. 2-4, a support bench 20 for the user of machine 2 is located on longitudinal rail 10 between side frame members 6. Bench 20 includes a generally horizontal seat 22 and a back rest 24 that may be inclined relative to seat 22. Both seat 22 and back rest 24, which are similar except for their lengths, comprise a padded or resilient cushion 27 attached to a base 28.

Back rest 24 may be moved from a position in which it is generally in the same plane as seat 22, i.e. to allow the user to lie flat thereon, to a position where it is inclined upwardly at any desired angle relative to seat 22, i.e. to allow the user to sit at least partially upright. This infinite adjustment of back rest 24 is accomplished with a seat adjuster 26 of the type commonly found on automobiles, specifically the one illustrated herein is taken from a Honda automobile.

Seat 22 is slidably mounted for longitudinal adjustment on rail 10 by two longitudinally extending support rods 30. Each rod 30 is fixed to seat 22 by placing it between inner and outer L-shaped mounting brackets 31 and 32 and securing it to the vertical walls thereof by bolts 33. Each outer bracket 32 has a horizontal wall 35 that is secured to the underside of base 28 of seat 22 by tap bolts 36 or the like. In FIG. 3, one rod 30 is broken away to illustrate the attachment of horizontal wall 35 to seat 22 with the other rod 30 being shown in full to illustrate the attachment of rod 30 to brackets 31 and 32. Inner bracket 31, which is considerably longer and thus extends further forwardly than outer bracket 32, also includes a horizontal wall 38. Wall 38 defines a support surface which rests on one end 39 of a saddle-shaped rod 40 fixed to the underside of rail 10 slightly in back of the junction between the horizontal and inclined portions thereof. The engagement between inner brackets 31 and rod 40 secure and stabilize support bench 20 on frame 4. In addition, seat 22 includes two forwardly inclined hand grips 41 which are threaded into the front end of outer brackets 32. Hand grips 41 may be held by the user while performing various exercises.

As shown in FIGS. 2 and 3, each of the longitudinal rods 30 slide in sleeves 42 which are fixedly mounted on longitudinal rail 10 by a cross-bracket 43. At least one sleeve 42 has a transverse hole 44 all the way therethrough which can be aligned with various ones of a set of holes 45 in one rod 30. A lock pin 46 having a spring biased ball (not shown) on the outer end thereof can be inserted through holes 44 in sleeve 42 and through any selected one of the holes 45 in rod 30 to lock support bench 20 in place on rail 10. Support bench 20 can be repositioned when necessary by releasing lock pin 46 to free rods 30 in sleeves 42 and by then pulling or pushing on seat 22 to slide the entire support bench 20 on rail 10. Obviously, inner brackets 31 should be long enough to always remain in engagement with rod 40 over the entire range of movement of bench 20.

Referring now to FIG. 4, seat adjuster 26 includes inner and outer seat brackets 48 and 49. Inner bracket 48 is bolted to the outside of one of the seat support brackets 32, e.g. using one of the bolts 33 and a second bolt 50, and includes a generally circular ear 51 that overlies the rear edge of seat 22. Outer bracket 49 is similarly secured to back rest 24 by bolts 50 and also includes a circular ear 52 which is pivotally received on a pivot pin 53 that extends outwardly from ear 51 of bracket 48. Pivot pin 53 includes a slot in its outer end in which one end of a torsion spring 54 is placed. The other end of torsion spring 54 is engaged by a tab 55 on outer bracket 49 so that torsion spring 54 is wound up or tensioned as back rest 24 lies flat, i.e. as it rotates in the direction of arrows A in FIG. 4. Thus, torsion spring 54 forms a means for counterbalancing the weight of back rest 24 and allows back rest 24 to flip up because of the spring tension when back rest 24 is released. A washer 56 overlies the hub of spring 54 and a spring clip 57 engages the outer end of pivot pin 53 to hold the parts of adjuster 26 in an assembled relationship. A circular cover 58 preferably encloses the ear 52 and spring 54. See FIG. 1. Seat adjuster 26 is used only on one side of seat 22. Appropriate hinge brackets and a simple hinge pin along the same axis as pivot pin 53 are used on the other side of seat 22.

As is typical in seat adjusters of this type, there is a ratchet and pawl connection (not shown) located on the mating or adjacent surfaces of ears 51 and 52 for locking back rest 24 relative to seat 22 in an adjusted position. The pawl is releasably actuated by a lever 59 which extends out through a slot 60 in outer bracket 49 and up along back rest 24 for actuation by the user. When lever 59 is pulled forwardly from its solid to its phantom line position, the pawl is disengaged from the ratchet to allow back rest 24 to be rotated around pivot pin 53. When the user releases lever 59, a spring restores lever 59 to its solid line position and reengages the pawl with the ratchet to relock back rest 24 relative to seat 22. While a seat adjuster 26 of the type shown herein is preferred because it allows a substantially infinite amount of variation of the angle of back rest 24 as determined by the spacing of the teeth on the ratchet, means for adjustably securing back rest 24 to seat 22 in only one or a few inclined positions could also be used.

Support bench 20 has been shown carried on frame 4 and slidably adjustable relative thereto. However, this is not strictly necessary to the present invention. It would be possible to delete longitudinal rail 10 and use a support bench having a seat and inclinable back rest which is entirely unconnected to frame 4, but which is supported instead on the floor.

The Resistance Means

The resistance means carried on frame 4 for providing the force against which the user exercises comprises two electrically operated brakes shown generally as 62, and preferably two electromagnetic brakes of any generally conventional type as is well known in the art. Brake 62 includes a generally circular case 63 that has an output shaft 64 projecting from one side thereof. Output shaft 64 forms part of or is connected to the armature of the brake with the armature being surrounded in a known manner by electrical windings. When electricity is supplied to the windings, a magnetic field is generated which resists rotation of the armature. Thus, rotation of output shaft 64 will be resisted by a variable force that is directly dependent upon the current supplied to the windings. The greater the amount of current, the greater the resistance to rotation, i.e. the greater the force against which the user exercises.

Referring now to FIGS. 1 and 2, each side frame member 6 carries one brake 62 in both a longitudinally movable and pivotal fashion using a generally identical slide or movable carriage 66 that incorporates a hinge 100. Each carriage 66 comprises opposed top and bottom clamps 67 and 68 that surround the circumference of side frame member 6 and are secured together by suitable bolts 69 or the like. Top clamp 67 is made from one piece and is basically semi-circular with side flanges 70 through which bolts 69 extend. Bottom clamp 68 actually comprises three separate parts which are individually bolted to top clamp 67, i.e. two small semi-circular clamps 71 on either side of a thickened central module 72 having a semi-circular bore that fits around side frame member 6. However, the parts comprising bottom clamp 68 could be integrally fashioned into a single part. While clamps 67 and 68 have been shown in the drawings as tightly clamped on side frame members 6, sufficient clearance or low friction bushings between the clamps and the side frame member are used to ensure smooth, non-binding movement of support carriage 66.

Figure 6:
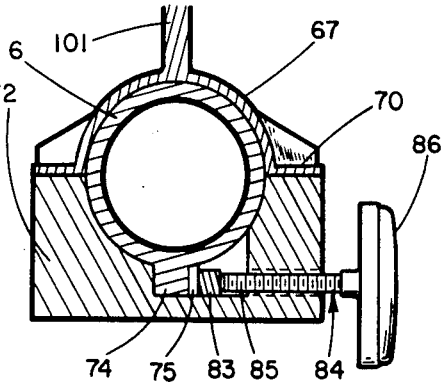
FIG. 6 is a cross-sectional view generally similar to FIG. 5, taken along lines corresponding to 6—6 in FIG. 2, particularly illustrating a first means for locking the movable carriage shown on the left side frame member.
Figure 5:
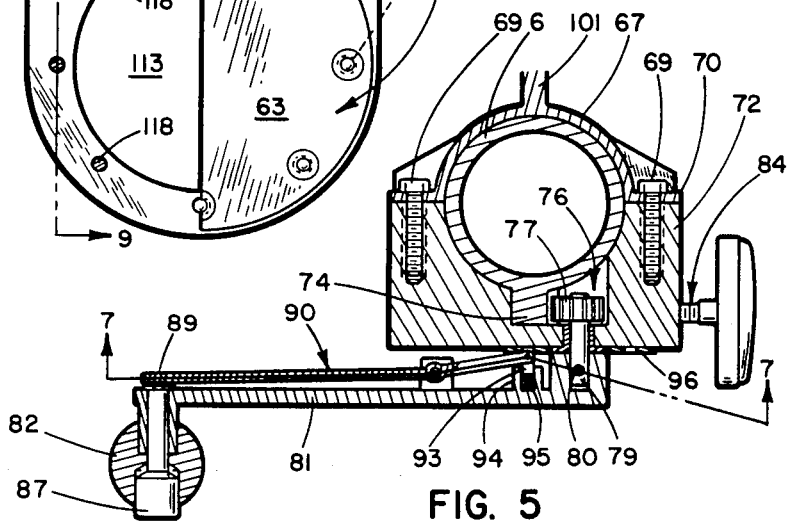
FIG. 5 is a cross-sectional view taken along lines corresponding to 5—5 in FIG. 2, particularly illustrated the movable carriage that slidably supports one of the electromagnetic brakes as shown on the left side frame member in FIG. 2 and the rack and pinion mechanism that supports the weight of the brake and moves the carriage up and down the side frame members.

Referring now to FIGS. 5 and 6, the underside of each side frame member 6 includes a gear toothed rack 74 along the arcuate curve thereof substantially from the top to the bottom: The gear teeth 75 of rack 74 face to the outside of side frame member 6. Central module 72 includes a cavity 76 which contains a rotatable pinion 77 that is engaged with rack 74, thereby forming a rack and pinion connection between side frame member 6 and carriage 66. Pinion 77 is mounted or keyed to the end of a shaft 79 which extends outwardly through module 72 to be coupled by a roll pin 80 to the end of a rotary handle 81. A rotatable ball 82 on the free end of handle 81 can be gripped to turn the handle. When handle 81 is rotated, pinion 77 will rotate in engagement with rack 74 to cause carriage 66 to move up and down along side frame member 6. This rack and pinion also helps support the weight of carriage 66 and eases the task of moving it up and down side frame member 6.

There are two separate locking means, i.e. a main lock and a secondary lock, for locking support carriage 66 in position on side frame member 6. The main lock is illustrated in FIG. 6 and comprises a rectangular block 83 located in cavity 76, or in a totally separate second cavity, above the location of pinion 77. Block 83 is suited to bear against the side of rack 74, i.e. it spans across a number of gear teeth 75. A threaded handle 84 has its inner end 85 located in cavity 76 in close proximity to block 83. The outer end 86 of handle 84 is located outside module 72 where it can be gripped by the user of machine 2. When handle 84 is turned in the appropriate direction, block 83 is forced into engagement with the outside of rack 74 to lock carriage 66 on side frame member 6. This main lock is desirably used whenever the brakes 62 are in use as an exercise device since it has more holding power than the secondary lock now to be described.

When it is desired to move carriage 66 from one position to another, the main lock defined by block 83 must first be released. However, if the user is not at the same time holding onto handle 81, Applicant has found that the weight of brake 62 will move the entire support carriage 66 in a rapid fashion down rack 74. Thus, handle 81 is provided with the secondary lock to prevent this, i.e. it serves to retain the support carriage 66 in its position, even when the main lock has been released, until it is also gripped and released by the user.

Figure 7:
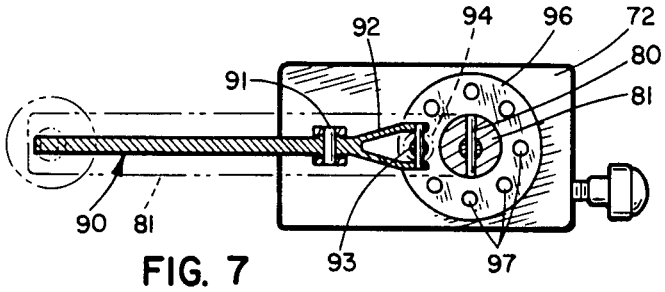
FIG. 7 is a cross-sectional view taken along lines 7—7 in FIG. 5, particularly illustrating a second means, attached to the handle of the rack and pinion for locking the movable carriage on the left side frame member as that carriage is shown in FIG. 2.

Referring now to FIGS. 5 and 7, the secondary lock includes a push button 87 retained in any suitable manner in ball 82 on handle 81. Push button 87 has an inner end that bears on one end 89 of a bell crank lever 90 that is rotatably journalled on a pivot pn 91 carried on the back of handle 81. The opposed end of bell crank lever 90 is formed as a fork 92 that is connected to a lock pin 93. Pin 93 is carried in a sleeve 94 on handle 81 and is normally spring biased upwardly by a spring 95 toward a plate 96 on one face of module 72. A plurality of circumferentially spaced locking holes 97 are provided on plate 96 for receiving lock pin 93. However, when the user wishes to turn handle 81 and cause a rotary movement of pinion 77 to move carriage 66, he must first push inwardly on push button 87 to cause lock pin 93 to be moved downwardly against the bias of spring 95 until it moves out of one of the locking holes 97. Rotary movement of handle 81, and hence movement of carriage 66, is then allowed.

Obviously, both the main lock and secondary locks could have any suitable form. For example, a secondary lock could also be provided by journalling handle 81 on pivot shaft 79 such that handle 81 could be rocked slightly toward and away from the rear face of module 72. A locking lug or the like could be provided on handle 81 which would then be swung into engagement with one of a plurality of recesses on the rear face of module 72. A spring could be used on handle 81 that would normally bias the handle into this locked position. Then, to unlock the handle, the operator would first have to rock the handle in an appropriate diretion to disengage the locking lug before the handle is rotated.

However, in the embodiment shown in the drawings, longitudinal movement of support carriage 66 is allowed on side frame members 6 by first unlocking the main lock by rotating threaded handle 84 outwardly, by engaging ball 82 on handle 81 with one hand, by then pushing inwardly on push button 87 to release the auxiliary lock, and by then rotating handle 81 in an appropriate direction to cause pinion 77 to either climb or descend rack 74 depending on the direction of handle rotation. In addition to this longitudinal movement up and down each of side frame members 6, each brake 62 may also be pivoted from a first position in which the working axis or output shaft 64 of brake 62 is generally horizontal to a second position in which it is generally vertical. This pivoting motion is allowed by the hinge structure generally referred to as 100 in FIG. 8 and 9.

Figure 8:
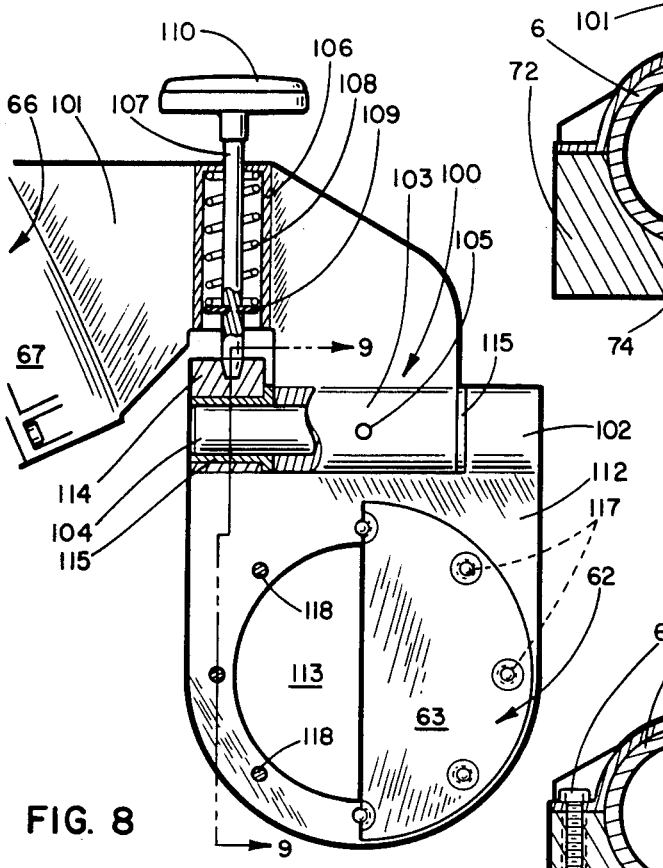
FIG. 8 is is a side elevational view of the movable carriage that slidably supports the electromagnetic brake on the right side frame member, with portions thereof being shown in cross-section to better illustrate the hinge means for pivotably supporting the brake on the carriage.
Figure 9:
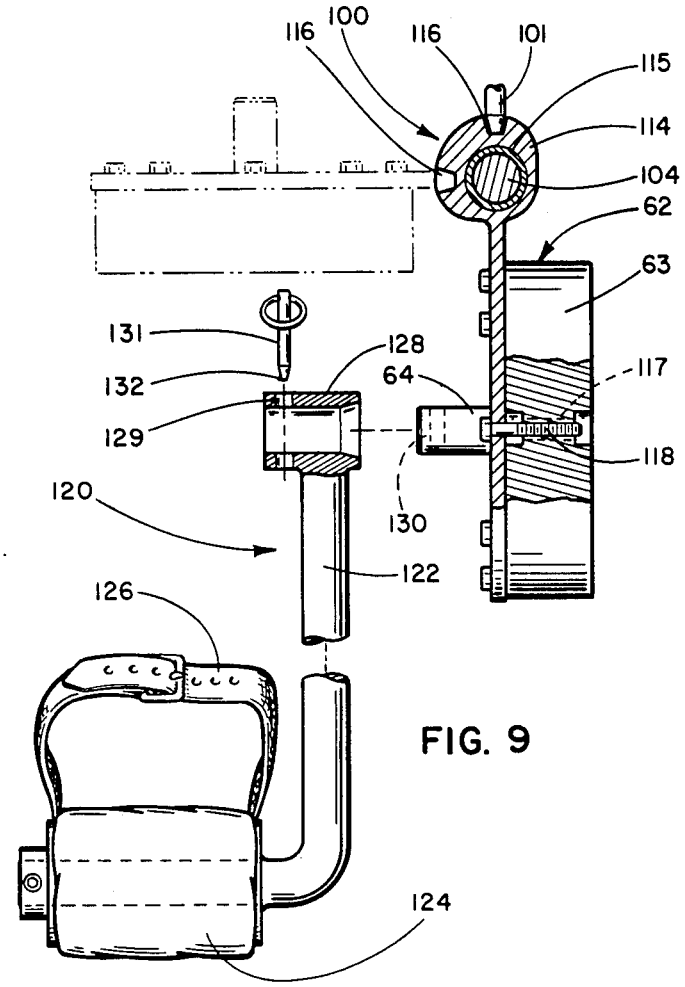
FIG. 9 is a cross-sectional view through the movable carriage on the left side frame member taken along lines generally corresponding to lines 9—9 in FIG. 8, particularly illustrating the pivoting motion of the brake and the locking means for locking the brake in position, and particularly illustrating one of the exercise attachments and a first embodiment of a connection means for securing said attachment to the brake shaft.

Referring now to FIGS. 8 and 9, top clamp 67 of each support carriage 66 includes a generally outwardly extending L-shaped support flange 101 the free leg 102 of which points downwardly. Leg 102 includes a circular boss 103 that carries therein a hinge pin 104 which is fixedly pinned at 105 to boss 103 so as to be non-rotatable. In addition, support flange 101 also includes a generally vertical circular boss 106 having a locking pin 107 contained therein. Pin 107 is spring biased downwardly by a spring 108 contained inside boss 106 which bears against the top of boss 106 and an enlarged washer 109 or the like on pin 107. Locking pin 107 can be moved upwardly against the bias of spring 108 by pulling upwardly on a handle 110 at the top end of pin 107.

Rotatably carried on hinge pin 104 is a support frame 112 having a fairly large circular opening 113 in the middle thereof and having two enlarged circular bosses 114 at each side thereof along the top edge. Each of these bosses 114 includes a flanged bushing 115 which receives hinge pin 104 for rotatably journalling support frame 112 on the pin in the fashion of a hinge. One of the circular bosses 114 includes a generally raised portion forming a cam having first and second locking recesses 116 spaced apart 90°. Recesses 116 are sized to engage the tapered end of locking pin 107 for locking support frame 112, and hence brakes 62, in either one of two positions. As shown in FIGS. 8 and 9, case 63 of brake 62 includes a plurality of threaded bores 117 around the periphery thereof which are accessible from either side of case 63. Brake case 63 is preferably mounted to the outside of each of the support frames 112 by bolts 118 which engage in bores 117. In this mounting brake shaft 64 extends inwardly through the open circular opening 113 to be pointed inwardly toward the interior of exercise machine 2.

Each brake 62 has a first position in which the brake is generally vertical, with output shaft 64 being generally horizontal, all as shown in solid lines in FIG. 9. However, when it is desired to pivot brake 62 to a generally horizontal position, with output shaft 64 then being generally vertical, pin 107 is first pulled upwardly to disengage the pin from one recess 116. The entire support frame 112 is then rotated about hinge pin 104 until brake 62 reaches its horizontal position shown in phantom lines. At this position the other recess 116 will be generally in alignment with the end of pin 107. When pin 107 is released, it will engage the other recess 116 and lock brake 62 in its horizontal position. Accordingly, each brake 62, in addition to being longitudinally movable along side frame members 6, is also pivotal relative thereto by virtue of hinge 100.

Applicant has found that when brakes 62 are mounted on support carriages 66 the entire assembly is relatively heavy. The rack and pinion means are desirably included for helping cary this weight and for moving carriage 66 along side frame members 6. However, some electrically operated brakes may be light enough such that the rack and pinion mechanism may not be needed. In such a case, simple slide members carried on the side frame members may suffice.

The Exercise Attachments and Connection Means Therefor

Obviously, for exercise machine 2 to perform useful exercising functions, various body contacting exercise attachments must be coupled to the rotary output shafts 64 of brakes 62. FIG. 1 illustrates a first attachment 119 which is useful for performing arm and chest exercises. FIG. 9 illustrates a second attachment 120 which is useful for performing various leg exercises. Generally, each of these attachments, along with two other attachments which comprise the entire set of attachments for machine 2, include a hollow sleeve that fits onto brake shaft 64, an elongated bar or arm that extends outwardly from the sleeve, and a body contacting member or set of members that are positioned at the end of the arm, or along the length of the arm, for contacting the body member being exercised. The exercise attachment shown in FIG. 9 will be described in detail, but the same major components are included in each of the other attachments.

FIG. 9 illustrates an exercise attachment 120 of the type used in leg extension and leg curl exercises. Attachment 120 comprises an L-shaped bar 122 having a padded roller 124 at one end. Although roller 124 is shown fixed to bar 122, it could be adjustably securred to bar 122, by connecting it to one of a series of spaced holes along bar 122, to vary the effective length of attachment 120 to suit the individual user. An adjustable strap 126, which could have Velcro type fasteners, is attached to roller 124 to help strap the user's foot thereto. Because of the use of brakes 62 which do not normally have a restoring force, strap 126 is needed in certain exercises to help the user return attachment 120 and brake shaft 64 to their initial positions. Attachment 120 is the only one, however, which requires such a strap. The other end of bar 122 includes a hollow sleeve 128 which may be slipped over shaft 64 of brake 62. Sleeve 128 includes a cross hole 129 which may be aligned with a cross hole 130 in shaft 64. A locking pin 131 having a ball 132 at one end which is spring biased outwardly may be inserted through holes 129 and 130 when they are aligned to lock attachment 120 to shaft 64. Thus, attachment 120 must be rotated by the user to cause rotary movement of shaft 64.

Figure 11:
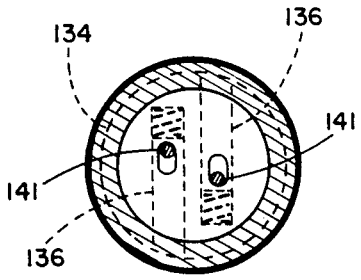
FIG. 11 is a cross-sectional view taken along lines 11—11 in FIG. 10.
Figure 10:
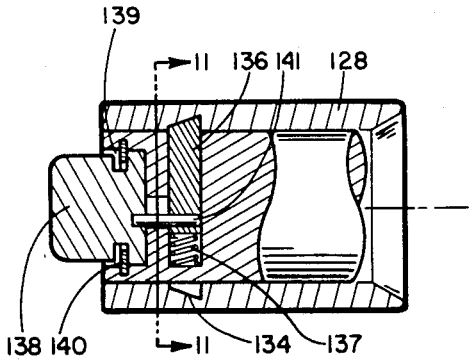
FIG. 10 is a cross-sectional view taken through the end of one brake shaft, particularly illustrating a second embodiment of a connection means for securing an exercise attachment to the shaft.

FIGS. 10 and 11 disclose a second embodiment for coupling attachment 120, or any of the other attachments, to brake shaft 64. This embodiment does not utilize a separate locking pin 131 which could inadvertently by lost by the user. In the second embodiment sleeve 128 generally has an inclined annular ramp 134 located generally adjacent the same spot at which cross hole 129 was. Ramp 134 could also be formed as groove having a rectangular cross section. In addition, the outer end of shaft 64 now includes two locking lugs 136 which are biased radially outwardly by springs 137. Locking lugs 136 normally project outwardly from the exterior circumference of shaft 64 so as to be engaged in ramp 134 and couple attachment 120 to shaft 64. The bore of sleeve 128 and the outer surface of shaft 64 have mating splines that allow resistance torque to be transmitted between brake 62 and attachment 120. In addition, the second embodiment also includes a means for releasing or camming lugs 136 radially inwardly to disengage ramp 134 and allow attachment 120 to be slipped off shaft 64. This releasing means comprises a circular knob 138 held in place in a cavity 139 at the outer end of shaft 64 by a snap ring 140. Knob 138 is rotatable and includes two drive pins 141 which extend inwardly and are coupled to lugs 136 respectively. When knob 138 is turned in the appropriate direction, the drive pins 141 will retract lugs 136 against the bias of springs 137. This allows lugs 136 to disengage ramp 134 to allow removal of attachment 120.

The Controller

As previously mentioned, an electronic controller or control system 200 is provided for allowing the user to set the effort level or force provided by brakes 62 depending upon the configuration of the apparatus and the muscle groups being exercised, and the overall conditioning level of the user. Further, the electronic control system permits the user to set a first torque setting for one direction of movement of the brake shafts 64, corresponding to a first half-cycle of the exercise, and a second torque setting for the return movement or second half-cycle. Applicant believes this is important since it allows the user to set or "tailor" the force levels in each half-cycle to the strength of the muscle groups being exercised in that particular half-cycle. Thus, the force levels in the second half-cycle could be higher or lower than the force levels in the first half-cycle. during exercise the control system also monitors operation and provides the user with convenient displays of the number of repetitions of the exercise cycle per minute, total number of repetitions per session, rate of energy expended per hour and the cumulative total energy expended during the session.

Figure 12:
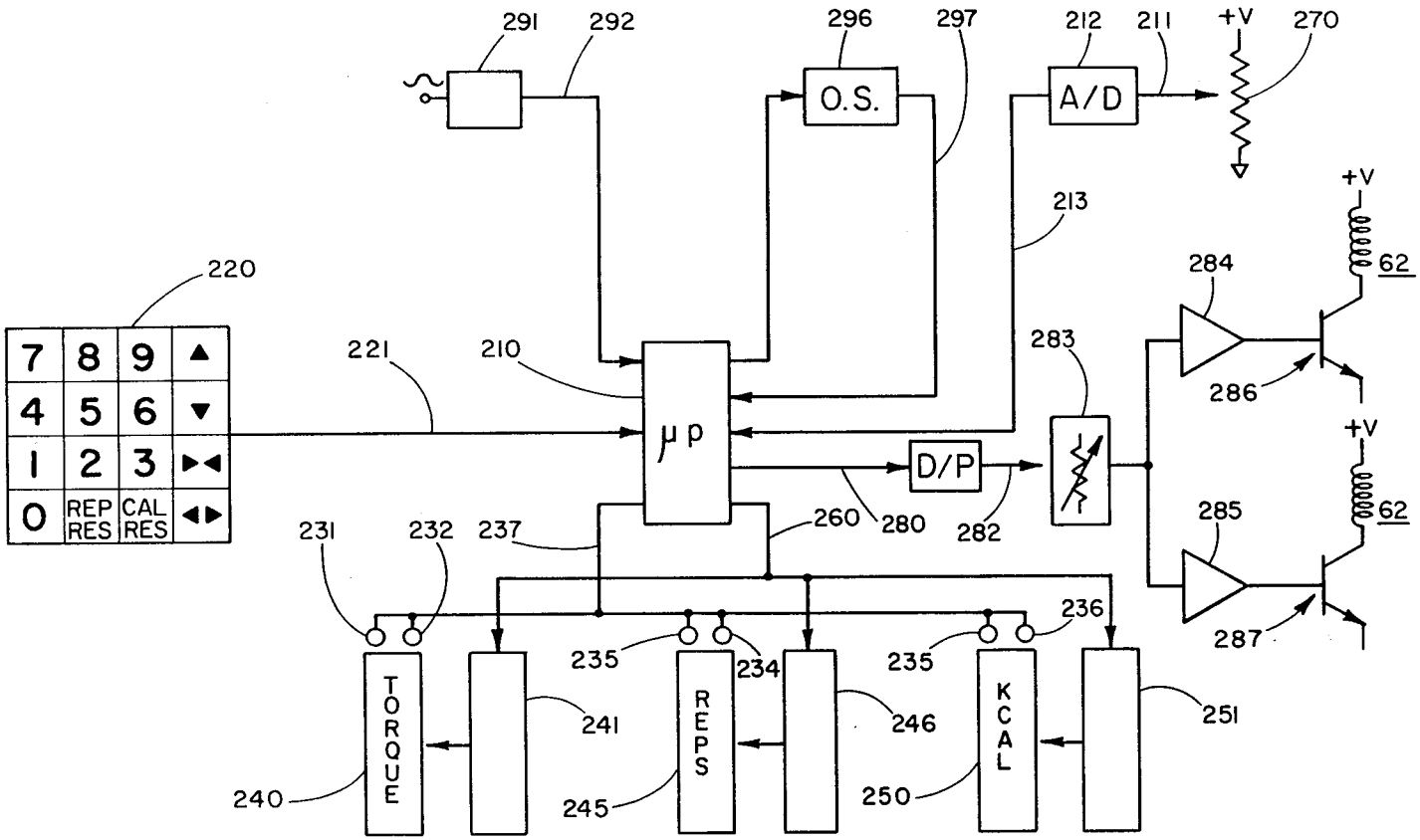
FIG. 12 is an electrical block diagram of the controller of the exercise machine according to the present invention.

Although the control system of this invention could take a number of different forms, the preferred form is a microprocessor-based controller such as indicated in FIG. 12. FIG. 12 is shown in block diagram form with signal connections between functional blocks generally indicated by single control lines. It will be appreciated, however, that in practice multiple signal or control lines may be required, depending on the number and type of ports of the microprocessor, i.e. serial or parallel, and requirements for providing chip select and clock signals to individual circuits, as well as power and ground connections as are generally known in the art. These have been omitted from the figure for purposes of clarity and because such details are generally known in the art and will vary depending on the particular type of microprocessor and other circuits used.

In FIG. 12, reference 210 designates a microprocessor, which has a number of input and output ports, and which includes a ROM memory containing an operating program for the control system as is explained further below. A keyboard 220 is provided to enable the user to enter torque settings into the controller. The preferred embodiment permits 20 to 200 foot-pound settings, although the machine could be designed for other values. Keyboard 220 is a conventional keypad comprising an array of 16 switches, one for each of the digits zero through nine, plus four for direction indicating switches and two reset switches. The direction indicating switches are for "up" and "down", "in", and "out", corresponding to the possible movements of the brakes depending on the orientation thereof. The two reset switches are for resetting the total repetitions and the total energy burned, respectively. Keyboard 220 communicates with microprocessor 210 over data line 221, which for convenience, is shown as a single lead in FIG. 12, but which in reality may comprise a number of data leads depending upon the design of the keyboard and the input port structure of the microprocessor, as is generally known.

A plurality of mode indicator lights 231–236 are provided on the control panel for indicating the current modes of the displays, and these are controlled by microprocessor 210 through data output line 237, which in reality comprises a number of individual data leads. Control lights 231–236 can consist of LED's with suitable transistor drivers as is generally known.

In addition to the mode indicator LED's, three numeric digital displays 240, 245 and 250 are provided for displaying numeric data for torque, repetitions and energy burn. These can comprise liquid crystal displays or LED displays as are generally known, and preferably provide 4 digits of display each. Displays 240, 245 and 250 are driven by display drivers 241, 246 and 251, respectively, which in turn receive data from a data line 260. For convenience in circuit layout, a serial output port of the microprocessor may be used with a single data line 260 going to all three display drivers, and with chip select lines (not shown) connecting from the microprocessor to the drivers 241, 246 and 251 separately to address data thereto. The drivers include latches for holding data received from the microprocessor.

The controller, or at least a portion thereof containing the keyboard, indicator LED's and displays are preferably mounted in a control box mounted on or adjacent the exercise machine, and preferably with the control panel thereof positionable for convenient access and viewing by the user.

Reference number 270 designates the sensing potentiometer associated with one of the brakes. This potentiometer is used for reading out the angular position of the brake shaft to provide position input information to the control system. Preferably, potentiometer 270 is manufactured integrally with one of the brakes 62 and is positioned within the housing thereof. Sources of voltage and ground are applied to potentiometer 270, and the variable tap thereof connects via lead 211 to an analog to digital converter 212. The digital output of A/D converter 212 is output over data lines 213 to an input port of microprocessor 210.

A data output port of microprocessor 210 connects over data line 280 to digital to analog converter 281. The analog output from this converter connects through line 282 to an offset, gain and balance control network 283, which in turn connects to inputs to operational amplifiers 284 and 285. The outputs of these amplifiers connect to power transistors 286 and 287, whose emitters are connected to ground and whose collectors are connected to control current flow through the windings of the brakes 62. Thus, the output signals provided at data line 280 will be converted into analog signals which are amplified and used to control the torque of the brakes 62. The network 283 is provided as a factory adjustment to provide offset and gain adjustments to allow matching of the output torque of brakes 62, to correct for any manufacturing tolerance in their torque-current characteristics, so that in operation both will provide the same torque.

A real time clock input is provided to the microprocessor, which for convenience is derived from the 60-cycle line current, since this is fast enough for purposes of this control system. The line voltage is applied to a switch transistor 290 which causes switching on control lead 292 at the 60 Hz line frequency, and this is conected to an input of the microprocessor as a clock reference. A separate high frequency clock (not shown) is provided as is generally known for operation of the microprocessor itself.

A further output of microprocessor 210 connects via line to a one-shot circuit 296, the output of which connects via line 297 to a reset input of microprocessor 210. This circuit serves a "watchdog" function which is explained below.

The general operation of the control system is as follows. Upon power up the total repetitions and total energy counts are cleared and the torque for both half cycles of the brakes are preset at the default setting of 20 foot-pounds. The operator may then enter the desired foot-pounds of torque for the up or in directions, and the down or out directions, by entering the appropriate numbers on the keyboard and the appropriate direction symbol, i.e. up, down, in or out. The user then begins the exercise.

During the exercise the controller continually senses position of the brakes by sensing voltage on the sensing potentiometer 270 and commands the preselected torque corresponding to the presently occurring direction of motion. By comparing successive position measurements, direction of motion of the brake can be determined as well as the beginning and ending of the half cycles. This is preferable to using limit switches or the like for sensing brake position, since that technique would assume or require that the user always move the brakes through a given arc. However, different arc lengths will be used depending on the user and the specific muscle group being exercised, and will also vary slightly on different repetitions within a set. For these reasons it is preferable to sense position only and let the user define his own repetition half-cycle starting points. The position of the sensor is read 60 times a second and by comparing the previous value from the sensor, the processor can determine the direction of movement or if movement of the brakes has stopped. When the user stops, marking the end of a half cycle of the exercise, stoppage of the brake shafts will be detected. If the stoppage lasts for more than a predetermined small increment of time, for example 1/10 of a second, the controller commands an output of the minimum of 20 foot-pounds. When motion is again detected and has exceeded a small predetermined amount, for example three degrees, the controller sets the appropriate preselected torque corresponding to the direction of the sensed motion, i.e. up/in or down/out. Setting the torque to a minimum value upon detection of stoppage is preferable to changing torque only on a change of direction, because if the user has set a high differential in torque for the two half-cycles, a situation might occur when at the end of an extension the user would not be able to start the return contraction because the torque is too high. If the controller is waiting for a change of direction before changing the torque, this may as a practical matter prevent the user from starting the return half-cycle. Setting to a nominally small torque upon stoppage, then quickly to the preset value on the return half-cycle avoids that problem.

At the end of a cycle, the controller calculates the number of repetitions per minute based on the length of time for the cycle as measured by the real time reference for beginning and ending of the cycle. The controller also calculates the energy, in kilo-calories, required for the half-cycle by noting the difference between the starting and stopping positions of the sensor for the half-cycle (the relationship of potentiometer voltage and brake shaft angle being known), and multiplying by the set torque for that half cycle and the appropriate conversion factor. The time rate of energy used (power) time can be calculated since the real time for the cycle is also measured. This is calculated in kilocalories per hour and displayed. At the same time, the total kilocalories of energy used for the exercise session, since power on, is updated.

Different types of display are possible, but for convenience the preferred embodiment uses displays 240, 245 and 250 to display one quantity during the first half-cyle and a separate, related quantity during the second half-cycle of the exercise cycle. Specifically, display 240 displays the preset torque corresponding to the current half-cycle. Display 245 displays repetitions per minute on the first half-cycle of the exercise cycle, and total repetitions on the second half-cycle, with the appropriate signal LED 233 or 234 indicating the quantity being displayed. Similarly, display 250 is used to show the rate of energy in kilocalories per hour on the first half-cycle and the total kilocalories shown on the second half-cycle, with the corresponding LED 235 or 236. Obviously, separate displays could be used for these functions, or an operator adjustable mode selection switch could be provided, but this technique is believed to be more advantageous since it uses fewer displays while still giving full information and not requiring operator action.

If desired, the operator can reset the total repetitions and total energy by pushing the appropriate reset keys.

Figures 13A, 13C:
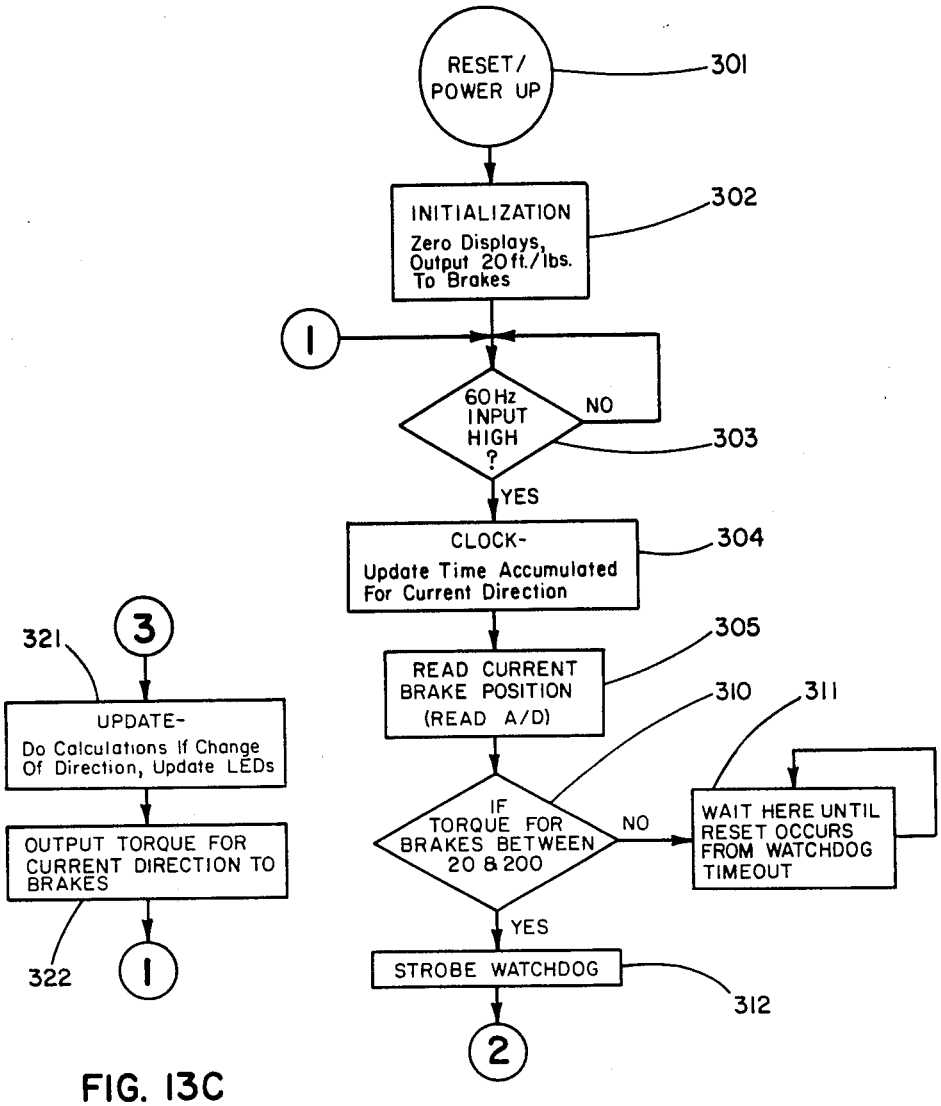
FIG. 13A through FIG. 13C comprise a flow chart illustrating the operation of the controller of FIG. 12.
Figure 13B:
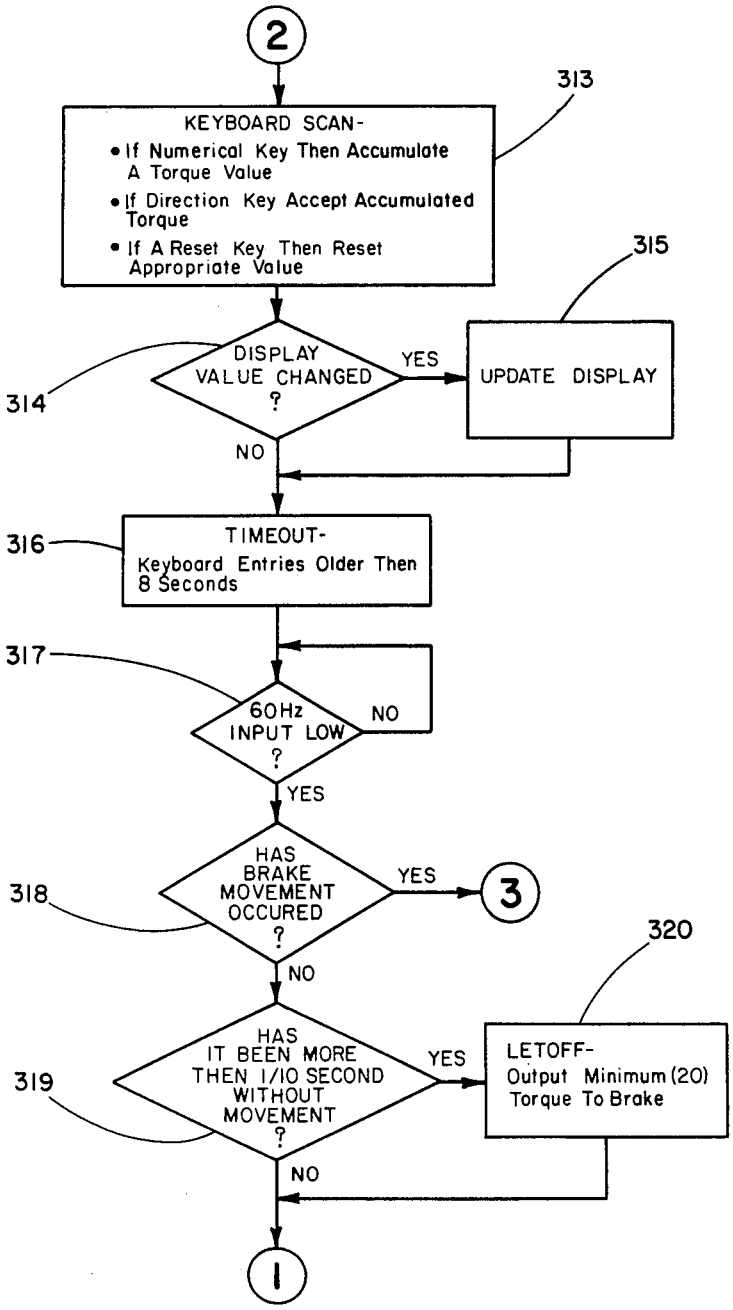

Referring now to FIGS. 13A–13C, a flowchart for the programming for microprocessor 210 is indicated. Upon occurrence of initial power up, or upon occurrence of a reset due to the time-out of watchdog timer 296, control begins as indicated by reference number 301 in FIG. 13. Control then proceeds to block 302 for system initialization. Specifically, the displays are zeroed, the accumulated repetitions and kilocalories are zeroed, and the minimum value of 20 foot-pounds of torque is commanded to the brakes. Control then passes to the decision block of the flowchart indicated by reference number 303. The 60 Hz input from lead 392 is tested. If low, control loops back and the processor waits for a high input. When that occurs control passes to block 304. The real time is then updated, which, of course, occurs every cycle of the 60 Hz input so that the real time is available for calculations. The time is also accumulated for the present direction of motion of the brakes, i.e. up/down or in/out as the case may be.

Control then passes to block 305, where the present brake position is read from potentiometer 270 through A to D converter 212. This brake position value will subsequently be used for detecting occurrence of end of a half-cycle, but certain other tasks are performed first. Decision block 310 and control blocks 311 and 312 are used in conjunction with the watchdog one shot 296 of FIG. 12, to guard against malfunction. It is theoretically possible that some error condition for example caused by electrical interference or the like could cause faulty data or instruction bits to occur, and the watchdog feature protects against system hang-up. Also, at decision block 310 is an incorrect torque value, i.e. one below 20 foot-pounds or one higher than 200 foot-pounds, is present, control branches to block 311 which causes waiting until a reset occurs from the watchdog time-out. If an appropriate value is found at decision block 310, control passes to block 312 which causes a strobe output on line 295 of FIG. 12 to the watchdog one shot 296. In normal operation, the microprocessor will pass all the way through the entire flowchart of FIGS. 13 and return to block 312 prior to the time-out value of one shot 296, with the result that the watchdog one shot is continually reset and never times out. However, if control has passed to block 311 as previously described, or if due to some faulty instruction caused by interference or errors, the program has hung up at some point, re-strobing of the watchdog will not occur and it will time-out, resulting in a reset and new initialization, at blocks 301 and 302 above.

In normal operation, following the strobing of the watchdog at block 312, control passes to block 313 in which the keyboard is scanned for key activation. If a numerical key activation occurs, the corresponding numbers are accumulated for use in setting a torque value. If a direction key, i.e. up, in, down or out, is depressed, the accumulated torque value is accepted as the new torque value for the corresponding half-cycle. If a reset key for total repetitions or total energy burn is depressed, then the appropriate value is reset to zero. If there is a change in a torque value or if total repetitions or energy has been reset, the appropriate change is made in the display at blocks 314 and 315. Control then passes to block 316 which times out and clears any keyboard entries older than 8 seconds without depression of a direction key.

At decision block 317, the 60 Hz input from lead 292 is again tested, this time for a low condition. If it is not low, control loops back and waits until the input does go low. Then control passes to a decision block 318 which tests whether brake movement has occurred. This is done by reading the present brake position, which was done in control block 305, and comparing it to the previous value. If movement has occurred, this means that the preset cycle, i.e. extension or retraction as the case may be, is still occurring, and control passes to control block 321. If the answer at decision block 318 is no, this means that the brake is stopped and control passes to decision block 319 which tests whether the brake has been stopped for more than a predetermined value, 1/10 of a second being used in the preferred embodiment. If not, control is passed again to decision block 303 on FIG. 13A, and the cycle just described for reading a new position etc. is repeated. Eventually control returns again to decision block 319 and if there has been more than 1/10 of a second without movement, control block 320 causes commanding of the output torque to the minimum setting of 20 foot-pounds. Control then returns to decision block 303 and the processor stays in the loop just described until eventually brake movement occurs again and is detected at decision block 318. Control then passes to block 321. If there has been a change of directions, calculations for repetition rate, total repetitions, energy burn rate and total energy are updated.

If the calculations are completed or if there was no change of direction, control passes to block 322, where the appropriate torque for the present direction of motion is output to the brakes. Thus, if the user stops during a cycle then continues in the same direction, the torque will first drop to the default value, but then will return to the selected value for that direction. If the user stops then starts back on the return half-cycle, torque is first set to the default value then quickly set to the preselected value for the return cycle. After control block 322, control passes again to decision block 303 and the process continues as described above.

While the flowchart of FIG. 13 is one way of programming the controller to achieve the desired result, many variations and alternatives are equally possible as will be appreciated by those skilled in the art.

Operation of the Exercise Machine

Applicant believes that exercise machine 2 according to the present invention is versatile to an unprecedented degree. One machine 2 allows the user thereof to properly isolate and exercise most of the major muscle groups of the body and, in fact, can do a number of exercises which before required entirely separate or unduly cumbersome machines. All of the exercises which machine 2 is capable of performing will be described in conjunction with FIGS. 14–22. For the purpose of clarity only brakes 62, and not carriages 66 are shown. Of course, each of the brakes 62 in each exercise must have its resistance programmed and controlled in the manners previously described with respect to operation of controller 200.

Figure 14:
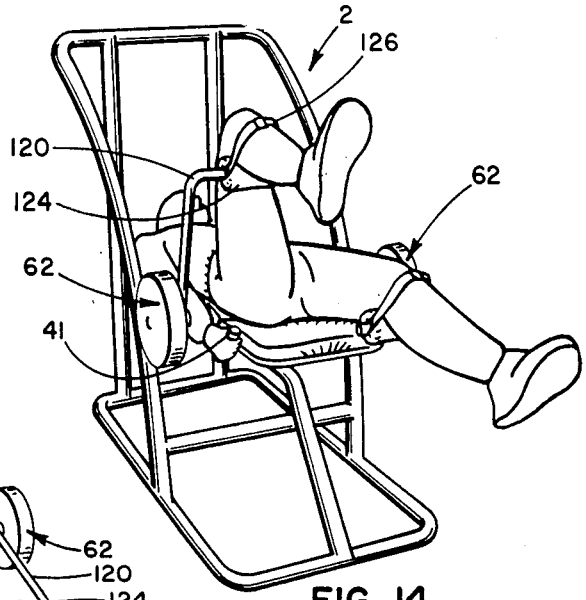
FIG. 14 is a perspective view of the exercise machine shown in FIG. 1, particularly illustrating use of the machine for accomplishing a hip and back exercise.

Referring first to FIG. 14, machine 2 is shown with back rest 24 flat allowing the user to lie on his back to perform a hip and back exercise which is effective on the gluteus maximus and hamstring muscles. The user desirably holds the hand grips 41 while performing this and other exercises all as shown in the drawings or as a matter of personal preference. Each brake 62 is positioned as shown with its output shaft 64 horizontal. Attachment 120 is then coupled to brake shaft 62 using either of the connection means described in FIGS. 9–11. The normal initial position of attachment 120 for this exercise will be generally in a raised position, as shown in engagement with the user's right leg with leg roller 124 generally in back of the knee and strap 126 secured around the top of the user's leg. To exercise, the user then presses downwardly with his leg to rotate attachment 120 to its horizontal position shown generally by the left leg. When the user raises his leg in a return movement, attachment 120 is carried back to its initial position by strap 126. The legs may be alternately raised and lowered in this motion as shown in FIG. 14 or may be raised and lowered simultaneously.

Figure 15:
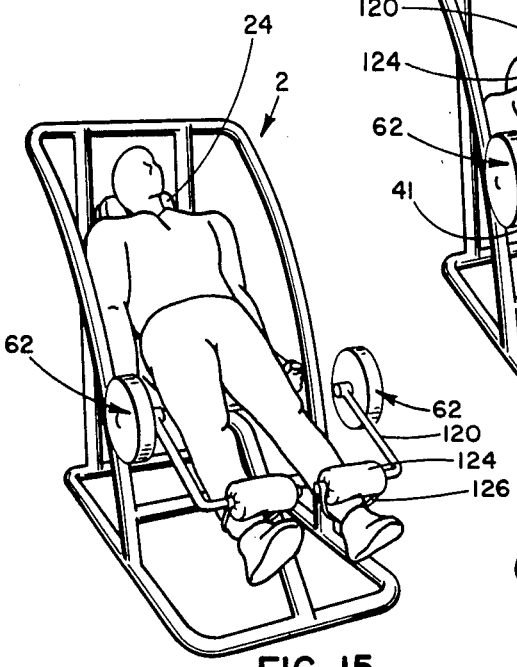
FIG. 15 is a view similar to FIG. 14, but showing use of the machine for accomplishing a leg extension exercise.

FIG. 15 shows machine 2 set up for a leg extension exercise which is effective on the frontal thighs or quadriceps. In this exercise, brakes 62 are somewhat further down side frame members 6 and attachments 120 are now coupled thereto so that their initial position will be one where they hang generally vertically downwardly. The user then sits partially upright on support bench 20, i.e. back rest 24 is raised, with his legs hanging downwardly over seat 22 and again holds hand grips 41. The user places his ankles behind leg rollers 124 and secures straps 126 around the back of his legs. He then simultaneously raises both legs to rotate attachment 120 from its initial position to a second position in which it is generally horizontal. FIG. 15 illustrates the legs when they are relatively close to this horizontal position.

Figure 16:
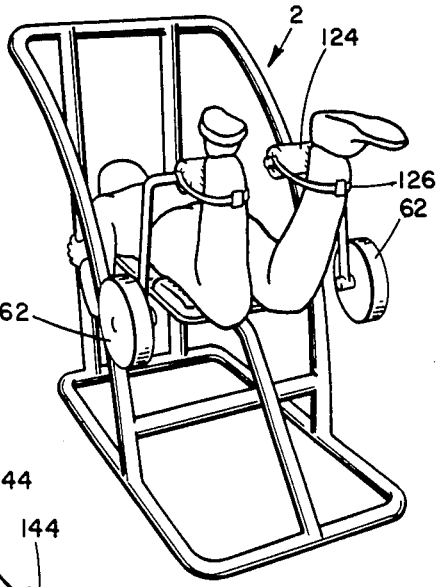
FIG. 16 is a view similar to FIG. 14, but showing use of the machine for accomplishing a leg curl exercise.

FIG. 16 shows machine 2 set up for a leg curl exercise which is effective on the hamstrings. In this exercise, attachment 120 is generally horizontal in its initial position and extends out from brake 62 away from seat 22. The user lies face down on support bench 20, i.e. back rest 24 is flat again, with his legs underneath rollers 124. Straps 126 are secured around the front of his legs. Hen then bends or curls his legs upwardly to raise the rollers from their first horizontal position to the second generally vertical position shown in FIG. 16.

The exercises shown in FIGS. 15 and 16 involve exercises in which the user bends his legs about substantially horizontal pivot axes through the knees. Brakes 62 are positioned on side frame members 6 so that their output shafts 64 generally align with the knee joints. However, there is a desirable set of exercises in which the legs are exercised by a scissors-type pivoting motion through the generally vertical axes extending through the hips and buttocks. These exercises are known as the leg abduction and adduction exercises and are shown being performed in FIG. 17. For this exercise, brakes 62 are still on the lower portion of the side frame members 6, but have been pivoted to their horizontal position so that brake shafts 64 now extend generally vertically and are located beneath the buttocks. In addition, another attachment 143 is now coupled to the shaft of each brake. Attachment 143 is of the same general construction as attachment 120 (i.e. a sleeve and elongated bar), but uses two, upwardly facing, U-shaped leg cradles 144 spaced along the length of the attachment bar as opposed to the leg roller 124. Each leg of the user fits between the opposed side pads of cradles 144 as shown in FIG. 17.

Figure 17:
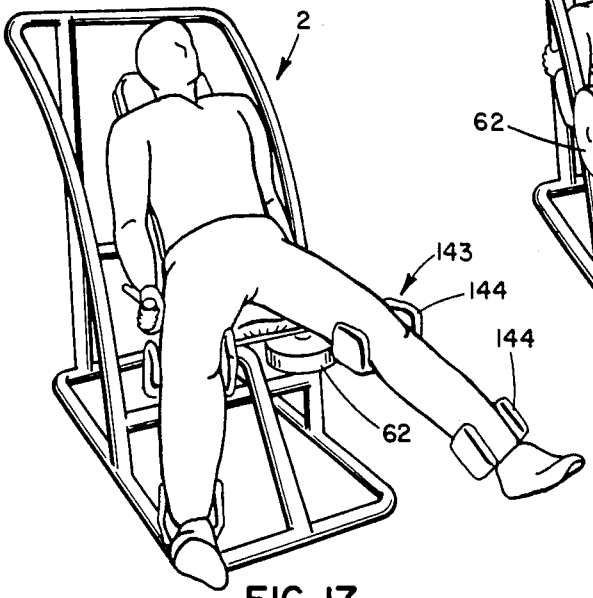
FIG. 17 is a view similar to FIG. 14, but showing use of the machine for accomplishing leg abduction and adduction exercises.

Referring now to FIG. 17, machine 2 is shown set up for performing leg abduction and adduction exercises which are effective both on the muscles of the inner thighs and outer hips. The exercises may be performed in two ways determined by the initial position of attachment 143. One way is for the user to start with his legs spread apart as shown in FIG. 17. He then closes his legs together against the resistance of brakes 62 by bearing inwardly against the inner pads on each of cradles 144. The legs may then be spread apart to reset attachments 143 to their initial orientation. When the major resistance force is encountered when the operator closes his legs as just described, it is particularly effective for exercising the inner thigh muscles. The other way for performing these exercises is basically the reverse of that just described. In other words, the initial positions for attachments 143 are closed together and the major resistance is applied as the user attempts to spread his legs apart to open them into the position shown in FIG. 17. When this is the case, this exercise is particularly effective for exercising the muscles of the outer hips, such as the gluteus medius muscles.

This completes the description of the lower body exercises which machine 2 is primarily designed to accomplish. Consideration will now be given to various upper body exercises which may be performed. For such exercises each of the brakes 62 is moved upwardly along the curve of side frame member 6 to be positioned in generally appropriate spots as illustrated in the following drawings. Each brake 62 is moved individually and is lined up with the other brake by eye. It would be possible for each side frame member 6 to have a scale or indicia thereon which would assist the user in placing each brake 62 at generally the same vertical elevation along side frame members 6.

Referring now to FIG. 1, attachment 119 is used for many of the arm and chest exercises. It again includes a sleeve 145 and an outwardly extending arm or bar 146 which is secured to brake shaft 64 similarly to that of attachment 120. The end of arm 146 includes a U-shaped handle 147 having top and bottom grips 148 and 149. Handle 147 may be attached to arm 146 in one of several holes, depending on the size of the user. Use of the attachment 119 for various exercises will now be described.

Figure 18:
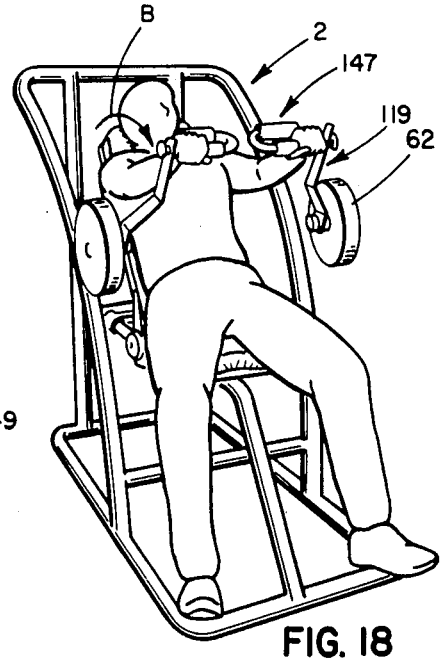
FIG. 18 is a view similar to FIG. 14, but showing use of the machine for accomplishing a chest press type exercise.

FIG. 18 shows machine 2 set up for performing a chest press-type exercise which is effective for exercising the muscles of the chest and shoulders. Brakes 62 have been moved up side frame members 6 to the positions shown and attachments 119 are coupled to each brake. The initial or starting position of the attachments 119 are in close proximity to the body with the arms being bent or cocked. The user then grabs handles 147 on each attachment 119 and pushes out away from him to extend his arms straight out into the position shown in FIG. 18. Because attachments 119 rotate on shafts 64, handles 147 do not move purely in a linear relationship relative to the body, but will follow a slight arc generally represented by the arrows B. However, the amount of such an arc can be minimized by appropriate longitudinal positioning of support bench 20 on frame 4 relative to the position of brakes 62 such that the arc closely simulates a straight-line linear pushing motion. While FIG. 18 shows the chest press exercise being performed with the user in a partially upright position, the user could lie flat and perform the same type of exercise with a repositioning of the brakes 62 and attachments 119.

Figure 20:
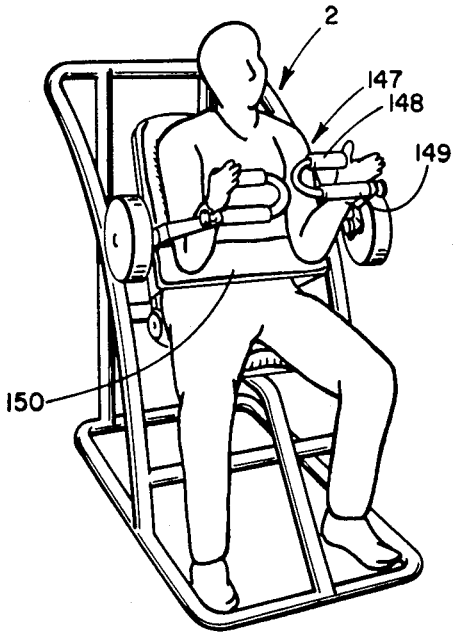
FIG. 20 is a view similar to FIG. 14, but showing use of the machine to accomplish a triceps extension exercise.
Figure 19:
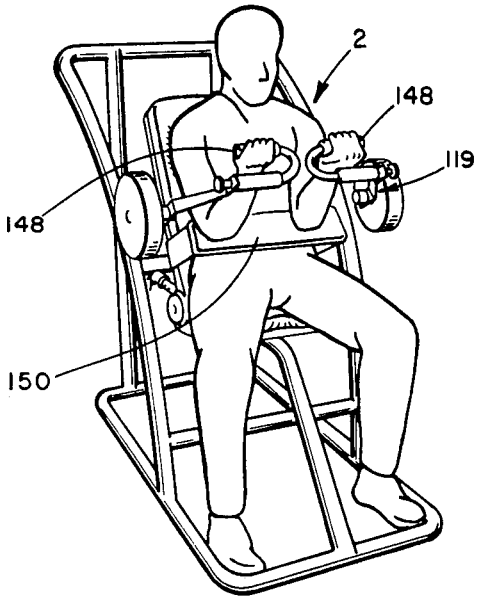
FIG. 19 is a view similar to FIG. 14, but showing use of the machine for accomplishing a biceps curl exercise.

FIGS. 19 and 20 disclose, respectively, machine 2 set up for performing a biceps curl exercise and a triceps extension exercise. The brake shafts 64 are aligned with the pivot through the elbows. In this exercise, a flat pad or plate 150 is suitably releasably connected either to support bench 20 or to brake cases 63 in any suitable manner so as to overlie the abdomen of the user. Plate 150 helps the user properly isolate the biceps and triceps muscles while doing these exercises. Basically, in the biceps curl shown in FIG. 19, the user grips top grips 148 of handle 147 and curls his arms upwardly from a first position in which they are extended away from the body to a final position close to the body. Having accomplished this portion of the exercise, the user may then do the triceps extension shown in FIG. 20. This exercise involves releasing the top hand grips 148 and rotating the hands 90° to bear on edge against the lower hand grips 149 of attachment 119. The user then rotates his arms downwardly to extend them from the position in which they are close to his body to a position in which they are again spaced away from his body as shown in FIG. 19. Attachment 119 could have a longitudinal pad or support surface connected to or adjacent lower hand grip 149 for further helping support the edge of the user's hands in the triceps extension exercise.

Figure 21:
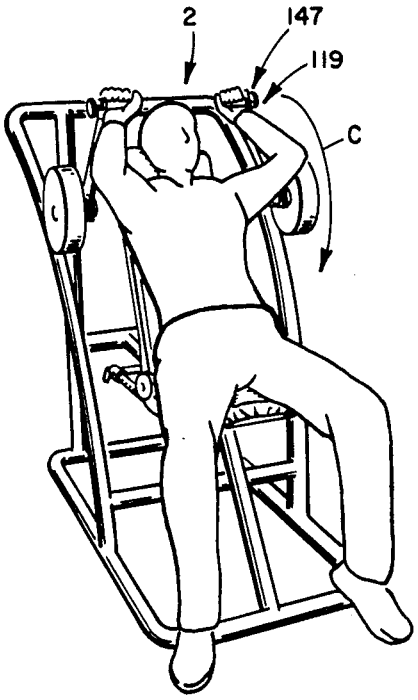
FIG. 21 is a view similar to FIG. 14, but showing use of the machine to accomplish an arm pull over exercise.
Figure 22:
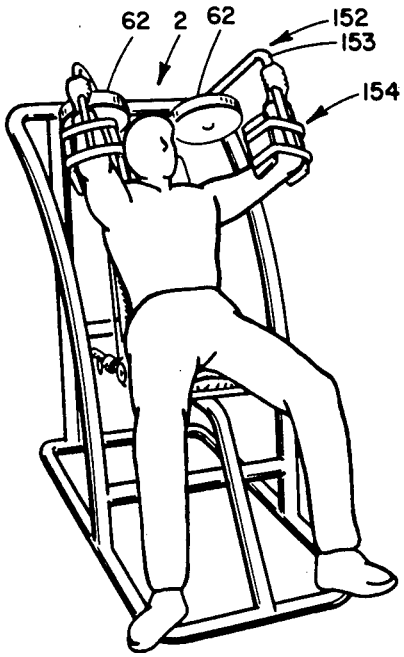
FIG. 22 is a view similar to FIG. 14, but showing use of the machine to accomplish an arm cross exercise.

Referring now to FIG. 21, machine 2 is shown set up for performing an arm pull-over exercise which is particularly effective for exercising the latissimus dorsi muscles. In this exercise, the user is again supported in a partially upright position and brakes 62 have been moved further up side frame members 6 until the shaft 64 aligns with the shoulder joint. The initial position for each of the attachments 119 is now one in which they point generally vertically upwardly. The user grips one of the hand grips 148 or 149 on handle 147 and then pulls his arms downwardly from the first or initial position shown in FIG. 21 to a second position or final position in which the arms have been rotated about 180° to lie close along the sides of the body. This range of movement is represented by the arrow C.

Finally, FIG. 22 again illustrates the versatility of exercise machine 2. Brakes 62 are pivoted again into their horizontal position with their axes pointing generally vertically although they are now on the upper portions of side frame members 6. In such a position, a fourth attachment 152 is illustrated which includes a bar 153 for coupling through the aforementioned sleeve to the output shaft of the brake. The lower end of the bar 153 includes a rearwardly facing arm cradle 154 having inner and outer pads between which the arm of the user is received. The user's hands can grip bars 153 adjacent arm cradle 154 or a separate handle could be provided on bars 153 for the user's hand to grip. In any event, the user is now able to perform an arm cross exercise which is particularly effective for exercising many of the muscles of the chest, such as the pectoralis majors and the deltoids. The initial position of attachments 153 is shown FIG. 22. The exercise may be performed by closing the arms together in a scissors fashion pivoting them about the vertical axes through the shoulders. The arms can then be spread back apart to the initial position, thus exercising the trapezius muscles of the upper back.

It should be apparent at a glance that exercise machine 2 is quite versatile. It uses a resistance means comprising two brakes 62 for performing many different exercise movements which properly isolate and exercise specific muscle groups. Moreover, it does this while the user is supported in the position which is generally considered to be the optimum position for performing each such exercise. In this regard, support bench 20 can be move longitudinally along rail 10 to help position the user properly for the different exercises. In addition, back rest 24 which may be inclined relative to seat 22 allows the user to be supported in a sitting position substantially upright for performing many of the exercises, but also allows the user to lie flat for certain other exercises. Both the amount support bench 20 is slid forwardly or back on rail 20, and also the amount of inclination of back rest 24, is dictated by the exercise to be performed and the personal preference of the user. Accordingly, the user will be more inclined to utilize machine 2 and will derive more benefit therefrom.

It has been noted previously that side frame members 6 are inclined slightly outwardly as they rise from top to bottom. The reason why this is significant can be seen primarily with respect to the exercises being performed in FIGS. 17 and 22, i.e. the leg abduction and adduction exercise and arm cross exercise in which brakes 62 are horizontal with their pivot axes being generally vertical. In FIG. 17, the pivot axes defined by brake shafts 64 are desirably located immediately beneath the hip joints while in FIG. 22 the pivot axes are desirably aligned with the shoulder joints. However, the shoulders in most people are spaced farther apart than are the hip joints. Thus, the use of outwardly inclined side frame members 6 automatically lines up the pivot axes of the brakes with the pivot axes of the body parts since the brakes will have their pivot axes spaced farther apart in the upper position shown in FIG. 22 than in the lower position of FIG. 17. This insures the proper orientation of brakes 62 relative to the body while doing these exercises.

Moreover, the generally arcuate curve disclosed for side frame members 6 and shown in FIG. 2 is also important for much the same reason. Referring to the two positions of the brake shown in FIG. 2, and keeping in mind that the pivot axes are pointing vertically upwardly when brakes 62 are horizontal rather than vertical as shown in FIG. 2, the leg abduction and adduction exercises are performed in FIG. 17 with the user being seated generally in an upright position. It is desired that the pivot axes of the brake pass generally vertically upwardly through his buttocks and hip joints. However, in the arm cross exercise shown in FIG. 22, the pivot axes should be oriented generally along the plane extending through the shoulders and hips to be generally parallel to the upper part of the body and should not be skewed or inclined relative thereto. Because brakes 62 are mounted on arcuate side frame members 6, the arcuate curve automatically tips or inclines the generally vertically oriented brake axes so that they will be substantially parallel to the upper body of a user who is supported in a partially upright position when performing the arm cross exercise. Thus, the term "generally vertical" as used herein means simply that the brake axes are pointing more toward the vertical than the horizontal. Thus, in FIG. 22 the brake axes are not purely vertical, but are inclined somewhat to the vertical to be parallel to the body of the user, but can be still said to be "generally vertical".

Aerobic Exercise Using Machine 2

The primary use of exercise machine 2 is certainly as an anaerobic exerciser in which muscle capacity and size is increased using the exercises described or any combination or sequence of them which is desirable to the user. However, Applicant believes that it would be possible to also use exercise machine 2 as an aerobic exercise device since movement of the attachments and the brake shafts do not create any substantial inertial forces. Thus, it would be possible for a user to sit, for example, in the position of the arm cross exercise shown in FIG. 22 and set the force levels on brakes 62 relatively low in both phases or directions of the exercise movements. He could then fairly rapidly rotate his arms back and forth in a continuous fashion with a very large number of repetitions. He could do this sufficiently fast to elevate his heart rate into the recommended range for aerobaic benefit and could keep this up for a sufficient length of time to derive the aerobic benefit. Again, this would be possible since there are no substantial inertial forces which must be resisted when the direction of rotation of the attachments changes. This is unlike a weight stack device, or other exercise machines of that type, since the inertial forces imposed by the weight stack going in one direction would not allow a rapid universal and accompanying return motion. However, when it is desired purely to perform anaerobic exercise, it would be possible for the user to simply set the force levels on brakes 62 into the ranges required for such exercise, i.e. at higher force levels and in the manner previously described with respect to controller 200, and use a correspondingly lower number of repetitions.

The foregoing description has detailed the preferred embodiment of an exercise machine 2 according to this invention. Obviously, many variations and modifications are possible and would be within the skill of those in the art. Accordingly, the scope of this invention is to be limited only by the appended claims.

I claim:

1. An exercise machine, which comprises:

(a) a frame having an elongated frame member which extends over a particular distance;

(b) an electromagnetic resistance means carried on the frame member for generating a force that must be overcome by the user to achieve an exercise benefit, wherein the electromagnetic resistance means is bodily movable on the frame member between different positions for exercising different muscle groups;

(c) driving means for moving the resistance means on the frame member, wherein the driving means includes a control element which is manually manipulated by the user to operate the driving means;

(d) first locking means for locking the resistance means relative to the frame member; and (e) second locking means for locking the resistance means relative to the frame member. wherein the second locking means is operatively associated with the control element to be released as the user manipulates the control element, whereby the second locking means is capable of retaining the resistance means on the frame member after the first locking means has been released until such time as the user manipulates the control element to operate the driving means.

2. An exercise machine as recited in claim 1, wherein the driving means includes a rack and pinion connection between the resistance means and the frame member, and wherein the control element includes a manually operated crank handle connected to the pinion for rotating the pinion along the rack to move the resistance means.

3. An exercise machine as recited in claim 1, further including a support carriage on which the electromagnetic resistance means is carried and which carriage substantially surrounds the frame member, and wherein the first locking means includes a locking block carried on the support carriage and manually operated means for moving the block against the frame member to lock the support carriage relative to the frame member.

4. An exercise machine as recited in claim 3, further including means on the support carriage for pivotably mounting the electromagnetic resistance means relative thereto for movement of the resistance means into different planes.

* * * * *

UNITED STATES PATENT AND TRADEMARK OFFICE

CERTIFICATE OF CORRECTION

PATENT NO. : 4,730,829

DATED : March 15, 1988

INVENTOR(S) : Robert B. Carlson

It is certified that error appears in the above-identified patent and that said Letters Patent is hereby corrected as shown below:

On sheet 6, Figure 12, the block designated with reference numeral "291" should instead be designated with reference numeral --290--; the block labelled "D/P" should instead be labelled --D/A-- and should also be designated with reference numeral --281--; the reference numeral of the LED adjacent LED 234 should be changed from "235" to --233--; and the line leading from microprocessor 210 to device 296 should be identified with the reference numeral --295--.

On sheet 8, Figure 13B, block 316, the word "Then" should be changed to --Than--.

In the specification, column 15, lines 65-66, change "392" to --292--.

Signed and Sealed this

Twenty-eighth Day of March, 1989

*Attest:*

DONALD J. QUIGG

*Attesting Officer*

*Commissioner of Patents and Trademarks*